US007678039B2

(12) United States Patent
Åström

(10) Patent No.: US 7,678,039 B2
(45) Date of Patent: Mar. 16, 2010

(54) METHOD OF MONITORING OPERATION OF A CENTRIFUGAL SEPARATOR USING PRESSURE MEASUREMENT

(75) Inventor: Gunnar Åström, Huddinge (SE)

(73) Assignee: Alfa Laval Corporate AB (SE)

( * ) Notice: Subject to any disclaimer, the term of this patent is extended or adjusted under 35 U.S.C. 154(b) by 0 days.

(21) Appl. No.: 12/279,115

(22) PCT Filed: Feb. 12, 2007

(86) PCT No.: PCT/SE2007/000122

§ 371 (c)(1),
(2), (4) Date: Aug. 12, 2008

(87) PCT Pub. No.: WO2007/094715

PCT Pub. Date: Aug. 23, 2007

(65) Prior Publication Data

US 2009/0137377 A1 May 28, 2009

(30) Foreign Application Priority Data

Feb. 13, 2006 (SE) ..... 0600332

(51) Int. Cl.
*B04B 11/04* (2006.01)
*B04B 13/00* (2006.01)

(52) U.S. Cl. ..... 494/37; 494/2; 494/5; 494/10; 494/11

(58) Field of Classification Search ..... 494/1–6, 494/10, 11, 23, 25–30, 56, 68–70, 37
See application file for complete search history.

(56) References Cited

U.S. PATENT DOCUMENTS

| | | | | |
|---|---|---|---|---|
| 3,255,958 | A | 6/1966 | Simon | |
| 3,408,000 | A * | 10/1968 | Nilson | 494/10 |
| 3,580,493 | A * | 5/1971 | Jonsson | 494/2 |
| 3,642,196 | A * | 2/1972 | Nilsson | 494/2 |
| 5,800,330 | A * | 9/1998 | Modeer | 494/2 |
| 6,080,098 | A * | 6/2000 | Borgstrom et al. | 494/27 |
| 6,358,193 | B1 * | 3/2002 | Nyberg | 494/2 |
| 6,616,589 | B1 | 9/2003 | Maehans | |
| 6,837,842 | B1 * | 1/2005 | Dellden | 494/2 |
| 7,485,084 | B2 * | 2/2009 | Borgstrom et al. | 494/2 |
| 2009/0137377 | A1 * | 5/2009 | Astrom | 494/37 |

FOREIGN PATENT DOCUMENTS

JP 07246349 A * 9/1995

(Continued)

*Primary Examiner*—Charles E Cooley
(74) *Attorney, Agent, or Firm*—Michaud-Kinney Group LLP

(57) ABSTRACT

Method for supervising a centrifugal separator with a separating chamber, a radially inner outlet connected to the separating chamber and to an outlet conduit, with a flow detector disposed in the outlet conduit and adapted to detecting a flow in the outlet conduit, and an intermittently openable radially outer outlet connected to the separating chamber. In order reliably and easily to supervise the intermittent discharge of the centrifugal separator, the pressure is measured by a sensor disposed in a portion of the centrifugal separator which is pressure-transmittingly connected to a central portion of the interior of the rotor. If the supervision unit does not detect a pressure drop pulse from the sensor within a predetermined period of time from when an intermittent discharge is initiated, an alarm signal is emitted.

5 Claims, 1 Drawing Sheet

FOREIGN PATENT DOCUMENTS

| | | | | |
|---|---|---|---|---|
| JP | 07284693 | A | * | 10/1995 |
| JP | 2002119891 | A | * | 4/2002 |
| JP | 2002166198 | A | * | 6/2002 |
| WO | 2009/010630 | A1 | * | 1/2009 |
| WO | 2009/010631 | A1 | * | 1/2009 |

* cited by examiner

METHOD OF MONITORING OPERATION OF A CENTRIFUGAL SEPARATOR USING PRESSURE MEASUREMENT

FIELD OF THE INVENTION

The present invention relates to a method for supervising during operation a centrifugal separator which has a rotor which is supplied via a supply conduit with a liquid mixture of components which are to be separated. The mixture is supplied to an inlet chamber which is formed in the rotor and from which the mixture is led into a separating chamber which is formed in the rotor and connected to the inlet chamber. The main separation of the components of the mixture supplied takes place in the separating chamber, whereby a separated specifically light component accumulates in a central portion of the separating chamber from which the separated specifically light component is discharged during operation via a radially inner outlet connected to the central portion, and further out of the rotor via an outlet conduit connected to the radially inner outlet, and whereby at least one separated component which is specifically heavier than the first mentioned separated component accumulates in a radially outer portion of the separating chamber from which a discharge of a predetermined volume of the components in the separating chamber is initiated intermittently during operation and takes place via an intermittently openable radially outer outlet connected to the separating chamber at that radially outer portion. During supervision according to the invention, the time from when an intermittent discharge is initiated is measured.

BACKGROUND

During operation of a centrifugal separator of this kind the components in the liquid mixture which is supplied to the separating chamber via the inlet chamber of different densities are separated, whereby the specifically heaviest components are being accumulated in the radially outermost portion of the separating chamber. The accumulated volume of the heavier component gradually builds up radially inwards and thus eventually reaches a radial level at which part of the heavier component is entrained in the flow of a specifically lighter component radially inwards in the separating chamber and further out of the separating chamber via the radially inner outlet, thereby impairing the separation results. In order to be able to continue the centrifugal separation without impaired separation results, a predetermined volume of the contents of the separating chamber is intermittently discharged from the separating chamber via the radially outer outlet at regular intervals of time or when an impairment of the separation results is detectable.

The intermittent discharge in such cases is controlled by equipment which has a supervision unit comprising a device adapted to initiating the intermittent discharge of the predetermined volume while the separated component is discharged from the separating chamber, and to stopping the discharge and starting a resumption of normal separation in the separating chamber. The supervision unit often further comprises a time-measuring means, a memory and an indicating means.

In the German patent specification DE 41 11 933 C1 there is proposed a method of supervision in a centrifugal separator whereby a desired partial volume of the contents of the separating chamber is discharged intermittently in a correct manner. According to that method, the power consumption of the electric motor which drives the rotor of the centrifugal separator is measured immediately before an intermittent discharge, followed by measurement of the power consumption increase caused by the discharge. The difference between the resulting two measured values is compared with the value which corresponds to a power consumption increase due to a correct intermittent discharge, and deviations from that value are evaluated in a control unit.

However, the power consumption will also vary for other reasons, which means that an increase in it will not always be representative of a supervised discharge. The method also involves extra measuring equipment, which makes the supervision expensive.

In the Swedish patent specification SE 503 017 there is disclosed another method of supervision whereby a desired partial volume of the contents of the separating chamber is discharged intermittently in a correct manner and operation is supervised by measuring the time it takes for an outflow via the central outlet to be indicated again after it has ceased temporarily during an intermittent discharge. Although the method has great possibilities, it is complicated and expensive for some applications.

An object of the present invention is to provide a simple method for supervising a centrifugal separator of the kind described in the introduction, which method makes it possible reliably and at low cost to verify mainly that the initiated intermittent discharge of the predetermined volume has actually taken place.

SUMMARY

This above-described object is achieved by the pressure being measured by means of a sensor disposed in a portion of the centrifugal separator which is pressure-transmittingly connected to a central portion of the interior of the rotor, by the supervision unit detecting the presence of a pressure drop pulse from the sensor within a predetermined period of time from the time when an intermittent discharge is initiated, and by an alarm signal being emitted if a pressure drop pulse does not occur during the predetermined period of time.

According to one embodiment, the sensor is disposed in the supply conduit.

In another embodiment, the predetermined volume is discharged from the separating chamber via a radially outer outlet connected to the separating chamber at the latter's radially outermost periphery.

According to a further embodiment, the supply of the liquid mixture of components to be centrifugally separated is stopped before the predetermined volume is discharged intermittently and is resumed when the discharge has ended, the pressure measured by the sensor during the pressure drop pulse being lower than the pressure in the surroundings of the rotor, which is preferably atmospheric pressure.

According to yet another embodiment, the predetermined volume is the total volume of components present in the separating chamber.

BRIEF DESCRIPTION OF THE DRAWINGS

The sole FIGURE schematically shows an axial section through a rotor in a centrifugal separator which is adapted to being supervised in accordance with the present invention.

DETAILED DESCRIPTION

Figure 1:
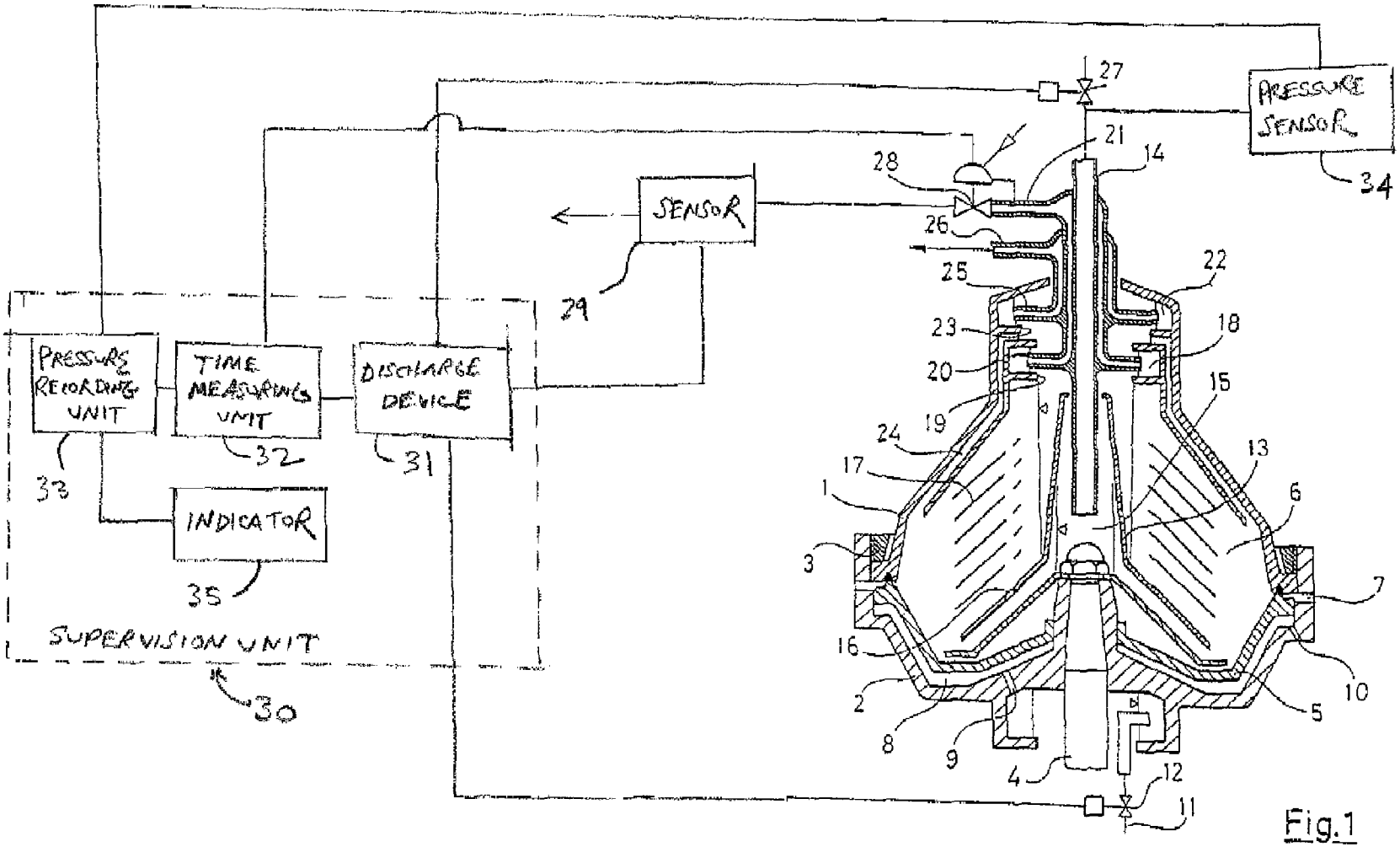

The rotor shown in FIG. 1 comprises an upper element 1 and a lower element 2 which are held together by a locking ring 3. The rotor is supported by a driveshaft 4 which is connected to the lower element 2.

Inside the rotor, a valve slide 5 is arranged for axial movement in the lower element 2. The valve slide 5 forms together with the upper element 1 a separation chamber 6 and is adapted to intermittently opening and closing an annular gap at the largest periphery of the separating chamber 6 between the separating chamber 6 and a radially outer outlet 7 for intermittent discharge of a component which during operation separates out from a liquid mixture supplied to the rotor and accumulates in the radially outer portion of the separating chamber 6. The valve slide 5 delimits together with the lower element 2 a seal chamber 8 which is provided with an inlet 9 and a constricted outlet 10 for a seal liquid. The seal liquid is supplied to the inlet via a conduit 11 which is provided with a magnetic valve 12.

A distributor 13 is disposed centrally in the rotor, which surrounds a stationary feed pipe 14 and forms within itself an inlet chamber 15 which communicates with the separating chamber 6 via holes 16 in the conical lower portion of the distributor 13 which are situated at a radius appropriate to the particular application. Within the separating chamber 6, a stack of a number of truncated conical separating discs 17 is disposed coaxially with the axis of rotation.

As shown in the figure, the upper element forms in its upper end a first central outlet chamber 18 for discharging a component separated during operation. This first outlet chamber 18 communicates with the separating chamber 6 via a first overflow outlet 19. In this outlet chamber 18, a first stationary discharge means 20 is adapted to discharging the separated component from the rotor via a first outlet conduit 21. The first overflow outlet 19, the first outlet chamber 18 and the first stationary discharge means 20 constitute together, for the separated component, a radially inner outlet which is connected to the separating chamber 6 via the first overflow outlet 19.

In the centrifugal separator shown by way of example, the upper element also forms a second central outlet chamber 22 which communicates with the separating chamber 6 via a second overflow outlet 23 and a duct 24 which leads into the separating chamber radially outside the first overflow outlet but radially within the connection of the radially outer outlet 7 to the separating chamber 6. A second stationary discharge means 25 disposed in this second outlet chamber 22 is connected to a second outlet conduit 26.

This extra outlet from the separating chamber 6 is not necessary for the invention but the embodiment exemplified shows that the invention is also applicable to the centrifugal separation of three components which form part of a liquid mixture supplied to a separating chamber 6, it being possible for the three separated components to be discharged via separate outlets.

The feed pipe 14 is provided with a valve 27 by which the supply of the liquid mixture of components to be separated can be interrupted before an intermittent discharge commences and be resumed when a discharge has ended.

The first outlet conduit 21 is provided with a backpressure valve 28. The first outlet conduit 21 in the example shown is also provided with a sensor 29 which detects the purity of the separated component flowing through the conduit. This sensor may for example detect the capacitance or conductivity of the separated component in the outlet conduit. The backpressure valve 28 may be supplemented by a shutoff valve (not shown) disposed in the outlet conduit 21 downstream from the backpressure valve 28.

A supervision unit 30 is connected to the centrifugal separator, which comprises a device 31 adapted to initiating the intermittent discharge, to end the discharge and to starting a resumption of normal separation in the separating chamber 6, which is commenced by refilling of the separating chamber 6 by supply of the liquid mixture of components, a time-measuring means 32 adapted to measuring the time from the time when an intermittent discharge is initiated or from a selected reference time relatable to that time, and to storing a adjustable period of time running from that time, a pressure-recording unit 33 adapted to recording at least during that period of time a pressure signal from a pressure sensor 34 which is disposed in the supply conduit 14 and is pressure-transmittingly connected to the central inlet chamber 15 formed in the interior of the rotor, and to recording a pressure drop pulse from the pressure sensor 34, and an indicating means 35 adapted to emitting an alarm signal if the pressure-recording unit 33 does not record any pressure drop pulse from the pressure sensor 34 during that period of time.

A centrifugal separator configured according to the invention functions in the following manner:

Upon start of the centrifugal separator the rotor is brought to rotate and the separating chamber 6 to be closed by the magnetic valve 12 opening so that seal liquid is supplied to the seal chamber 8 from the conduit 11 via the inlet 9. Thereafter the liquid mixture of components to be centrifugally separated is supplied to the separating chamber 6 via the feed pipe 14, the inlet chamber 15 and the supply holes 16 in the distributor 13 and is distributed out in intermediate spaces between the separating discs 17 where the main separation takes place. During the separation, the specifically heavier components (or component) flow(s) radially outwards and accumulate(s) in the radially outer portion of the separating chamber 6, while the specifically lighter component flows radially inwards and accumulates in a central annular layer in the separating chamber.

The separated specifically lighter component flows out from the separating chamber 6 via the overflow outlet 19 into the first outlet chamber 18. From this outlet chamber 18 the separated component is discharged through a first stationary discharge means 20 and on out from the rotor via a first outlet conduit 21 with a flow which passes the backpressure valve 28. The volume of the specifically heavier components accumulating in the radially outer portion of the separating chamber 6 increases gradually and eventually extends radially inwards to a radial level in the vicinity of the radially outer edges of the separating discs 17, resulting in some of the heaviest components (or component) being brought into the flow of the specifically lighter component radially inwards in the separating chamber 6 and hence leaving the separating chamber 6 via the overflow outlet and impairing the separation results. At regular intervals of time or when an impaired separation result is detected by the sensor 29, the device 31 initiates an intermittent discharge of a predetermined volume of the content of components in the separating chamber 6 via the outlet apertures 7.

Before a discharge commences in the example shown, the valve 27 preferably closes and the supply of liquid mixture to be centrifuged is cut off. Thereafter the magnetic valve 12 closes for a short time and the supply of seal liquid to the seal chamber via the inlet 9 is interrupted for that time. This causes the seal chamber 8 to be emptied of seal liquid via the outlet 10, the valve slide 5 to move downwards and an annular gap to open via which the predetermined volume of components rapidly flows out towards the outlet apertures 7.

Hereby, a pressure drop in the central portion of the interior of the rotor is created. The pressure may thus become lower in this central portion than the pressure in the surroundings of the rotor, which is preferably atmospheric pressure. This pressure drop is detected by the sensor 34, which emits a pressure drop pulse to the pressure-recording unit 33, which indicates that everything is in order and that an intermittent discharge has taken place. Thereafter the device 31 reopens the magnetic valve 12, the seal chamber fills and the annular gap closes. If the valve 27 was closed, the device 31 opens again and the separating chamber 6 refills and a resumption of normal separation in the separating chamber 6 can take place.

If the pressure-recording unit 33 does not record any pressure drop pulse from the sensor 34 within the period of time set in the time-measuring means 32, the indicating means emits an alarm signal which indicates that no intermittent discharge has taken place.

Although the pressure signal from the sensor 34 is mainly intended to be used for indicating whether a desired intermittent discharge has taken place or not, it is perfectly possible within the scope of the present invention to simultaneously utilise pressure signal deviations from normal to also indicate other faults occurring.

What is claimed is:

1. A method by means of a supervision unit for supervising during operation a centrifugal separator which has a rotor which is supplied via a supply conduit with a liquid mixture of components to be separated into an inlet chamber which is formed in the rotor and from which the mixture is led into a separating chamber which is formed in the rotor and connected to the inlet chamber and in which the components are mainly separated, whereby a separated specifically lighter component accumulates in a central portion of the separating chamber from which the separated specifically lighter component is discharged during operation via a radially inner outlet connected to that central portion and leaves the rotor via an outlet conduit connected to the radially inner outlet, and whereby at least one separated component which is specifically heavier than the first-named separated component accumulates in a radially outer portion of the separating chamber from which a discharge of a predetermined volume of the components in the separating chamber is initiated intermittently during operation and takes place via an intermittently openable radially outer outlet connected to the separating chamber at that radially outer portion, with measurement of the time from when an intermittent discharge is initiated;

measuring pressure in the interior of the rotor using a sensor disposed in a portion of the centrifugal separator which is pressure-transmittingly connected to the central portion of the interior of the rotor;

detecting via the supervision unit, the presence of a pressure drop pulse from the sensor within a predetermined period of time from when an intermittent discharge is initiated; and emitting an alarm signal if a pressure drop pulse does not occur during the predetermined period of time.

2. A method according to claim 1, wherein the sensor is disposed in the supply conduit.

3. A method according to claim 1, wherein the predetermined volume is discharged from the separating chamber via an outer outlet connected to the separating chamber at the latter's radially outermost periphery.

4. A method according to claim 1, wherein the supply of the liquid mixture of components to be centrifugally separated is shut off before the predetermined volume is discharged intermittently and is resumed when the discharge has ended, the pressure measured by the sensor during the pressure drop pulse being lower than the pressure in the surroundings of the rotor, which is preferably atmospheric pressure.

5. A method according to claim 1, wherein the predetermined volume is the total volume of components present in the separating chamber.

* * * * *